US008251753B2

(12) United States Patent
Guo et al.

(10) Patent No.: US 8,251,753 B2
(45) Date of Patent: Aug. 28, 2012

(54) ELECTRICAL CONNECTOR WITH CONTACTS FIRMLY RETAINED IN HOUSING

(75) Inventors: Jing-Jie Guo, Shenzhen (CN); Jin-Liang Du, Shenzhen (CN); Yin-Ji Zhou, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 80 days.

(21) Appl. No.: 12/917,517

(22) Filed: Nov. 2, 2010

(65) Prior Publication Data

US 2011/0104956 A1 May 5, 2011

(51) Int. Cl.
*H01R 24/04* (2006.01)

(52) U.S. Cl. ..... 439/668

(58) Field of Classification Search ..... 439/668, 439/669

See application file for complete search history.

(56) References Cited

U.S. PATENT DOCUMENTS 4,165,147 A * 8/1979 Buck ..... 439/668
4,364,625 A * 12/1982 Baker et al. ..... 439/669
4,367,907 A * 1/1983 Buck ..... 439/669
5,092,795 A * 3/1992 Kitagawa ..... 439/668
7,033,226 B1 * 4/2006 Chien et al. ..... 439/668
7,285,024 B1 * 10/2007 Tai ..... 439/668
7,387,543 B1 * 6/2008 Wu et al. ..... 439/668
7,637,787 B2 * 12/2009 Chien et al. ..... 439/668
7,717,755 B2 * 5/2010 Zhang et al. ..... 439/669
7,785,119 B1 * 8/2010 Chiang ..... 439/668

* cited by examiner

*Primary Examiner* — Briggitte R Hammond
(74) *Attorney, Agent, or Firm* — Ming Chieh Chang; Wei Te Chung; Andrew C. Cheng

(57) ABSTRACT

An electrical connector (100) includes an insulative housing (1) and at least one contact (4) assembled to the insulative housing. The insulative housing defines an insertion hole (15) along a mating direction and a passageway (131) opening at an upper face (10) thereof. The passageway has a first slot (132) at a side face of the insulative housing and a second slot (133) positioned between the first slot and the insertion hole along a transverse direction which is perpendicular to the mating direction. The second slot communicates with the insertion hole. The insulative housing includes a supporting part (134) between the first slot and the second slot. The at least one contact is assembled to the insulative housing from the upper face. The at least one contact includes a curved portion (40) crossing over the supporting part, a first arm portion (41) extending downwardly from the curved portion and retained in the first slot of the passageway, a second arm portion (42) extending downwardly from the curved portion and received in the second slot of the passageway, and a contacting portion (44) extending from the second arm portion into the insertion hole.

17 Claims, 8 Drawing Sheets

ELECTRICAL CONNECTOR WITH CONTACTS FIRMLY RETAINED IN HOUSING

BACKGROUND OF THE INVENTION

1. Field of the Invention

The present invention relates generally to an electrical connector, and more particularly to an electrical connector having a plurality of contacts firmly retained in the housing.

2. Description of Related Arts

Audio jack connectors are widely used in consumer electronic products for transmitting audio signals. U.S. Pat. No. 7,717,755 issued on May 18, 2010 discloses an audio jack connector. The audio jack connector comprises an insulative housing and a plurality of contacts received in the insulative housing. The insulative housing defines a plurality of passageways for retaining the contacts and a receiving space for connecting with a mating connector. The passageways communicate with the receiving space. Each contact comprises a contacting portion extending into the receiving space. The contacting portions of the contacts are electrically connected with the mating connector when the mating connector is inserted into the receiving space. Because the contacts are assembled to the insulative housing from a lower side of the insulative housing, the contacts are prone to fall off therefrom under bending test or when a large insertion force is exerted, although the contacts are interferingly retained in the insulative housing.

Hence, an electrical connector having a plurality of contacts more fixedly retained in the housing is desired to overcome the aforementioned disadvantage of the prior art.

SUMMARY OF THE INVENTION

Accordingly, an object of the present invention is to provide an electrical connector preventing a plurality of contacts from falling off from the insulative housing and therefore, more fixedly retained in the housing.

To achieve the above object, an electrical connector includes an insulative housing and at least one contact assembled to the insulative housing. The insulative housing defines an insertion hole along a mating direction and a passageway opening at an upper face thereof. The passageway has a first slot at a side face of the insulative housing and a second slot positioned between the first slot and the insertion hole along a transverse direction which is perpendicular to the mating direction. The second slot communicates with the insertion hole. The insulative housing includes a supporting part between the first slot and the second slot. The at least one contact is assembled to the insulative housing from the upper face. The at least one contact includes a curved portion crossing over the supporting part, a first arm portion extending downwardly from the curved portion and retained in the first slot of the passageway, a second arm portion extending downwardly from the curved portion and received in the second slot of the passageway, and a contacting portion extending from the second arm portion into the insertion hole.

Other objects, advantages and novel features of the invention will become more apparent from the following detailed description when taken in conjunction with the accompanying drawings.

DETAILED DESCRIPTION OF THE PREFERRED EMBODIMENT

Figure 1:
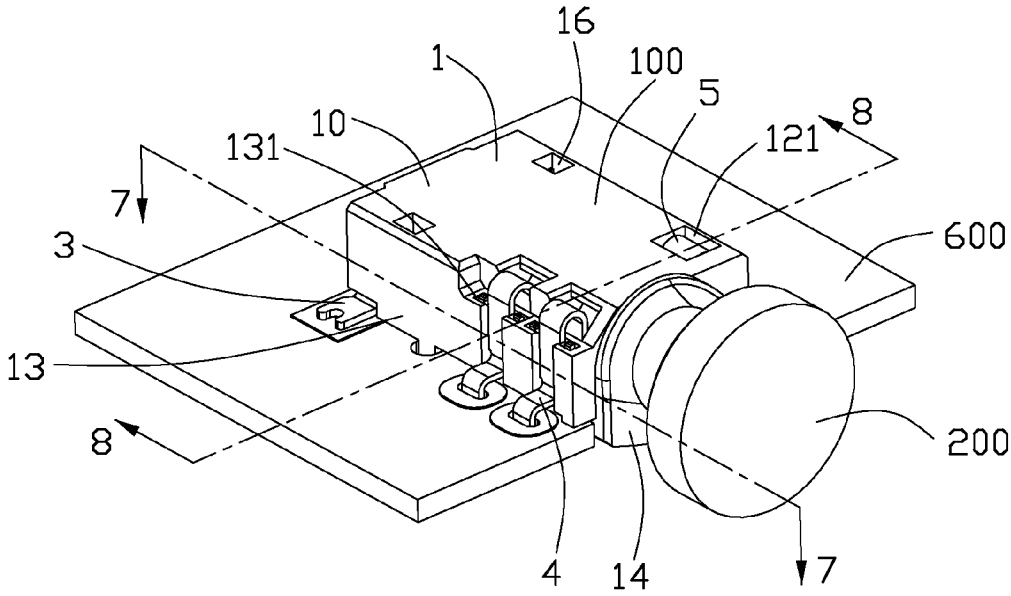
FIG. 1 is a perspective, assembled view of an electrical connector constructed in accordance with the present invention, a printed circuit board which the electrical connector is assembled on, and a mating connector which is engaged with the electrical connector.

Reference will now be made in detail to the preferred embodiment of the present invention.

Referring to FIGS. 1-8, an audio jack connector 100 in accordance with the present invention used for transmitting audio signals, comprises an insulative housing 1 and a plurality of contacts 3, 4, 5 assembled in the insulative housing 1. The audio jack connector 100 is assembled to a printed circuit board 600 for receiving a mating connector 200. The audio jack connector 100 is partly located lower than the printed circuit board 600 and partly located upper than the printed circuit board 600 for effectively utilizing spaces which are above and below the printed circuit board 600.

Figure 4:
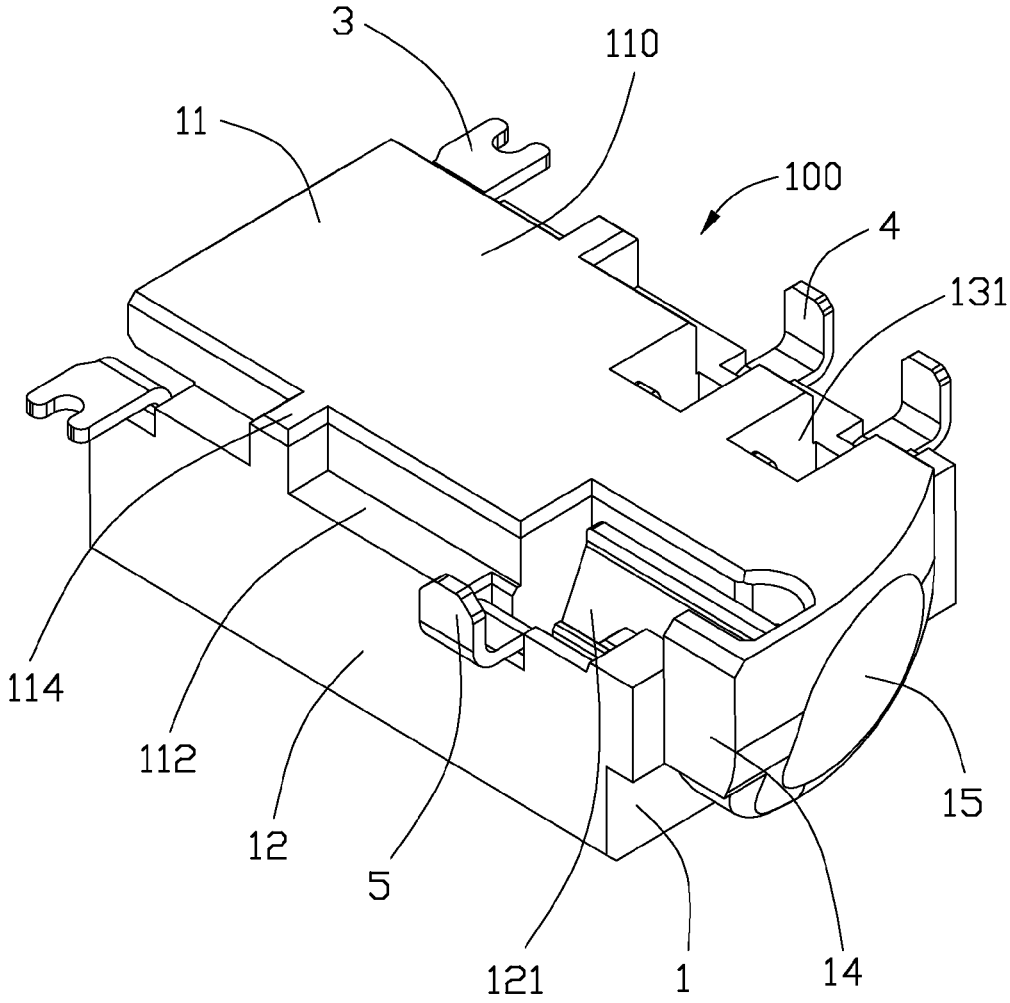
FIG. 4 is a perspective, assembled view of the electrical connector.
Figure 5:
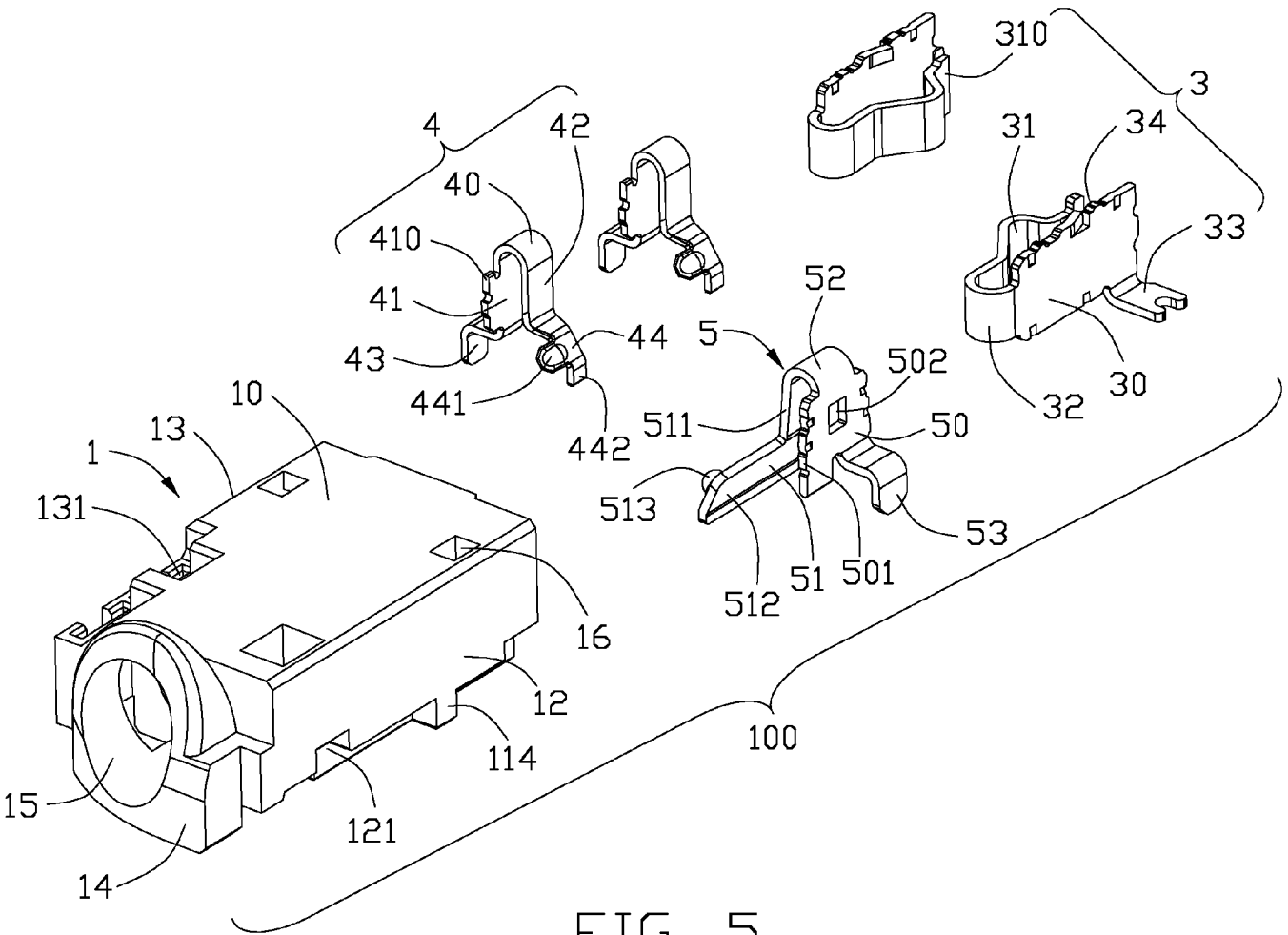
FIG. 5 is a perspective, exploded view of the electrical connector.
Figure 6:
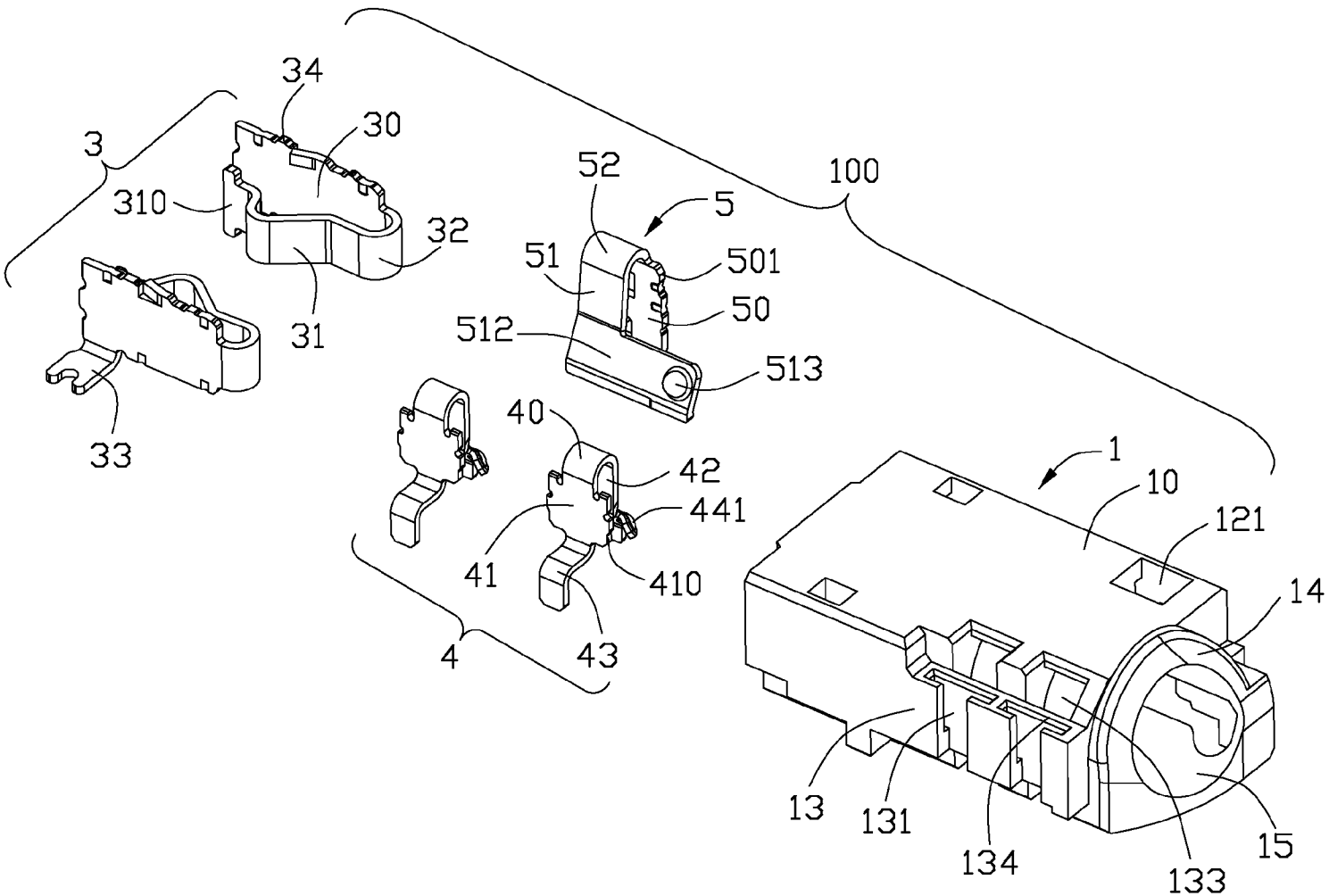
FIG. 6 is another perspective, exploded view of the electrical connector similar to FIG. 5, but taken from a different aspect.
Figure 7:
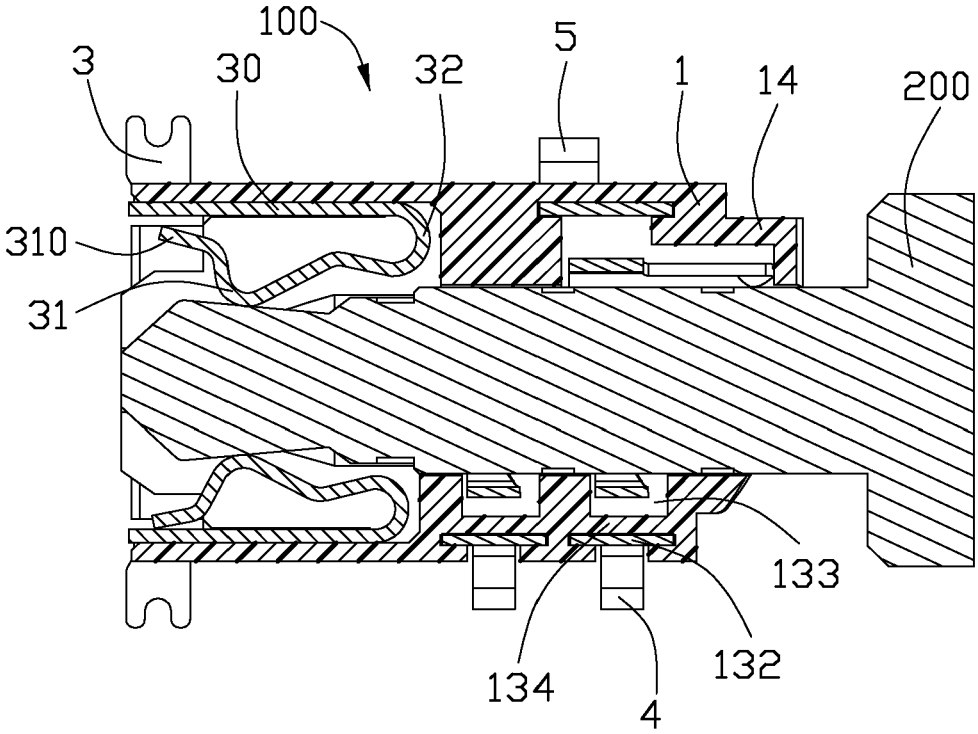
FIG. 7 is a cross-sectional view of the electrical connector taken along line 7-7 of FIG. 1.
Figure 8:
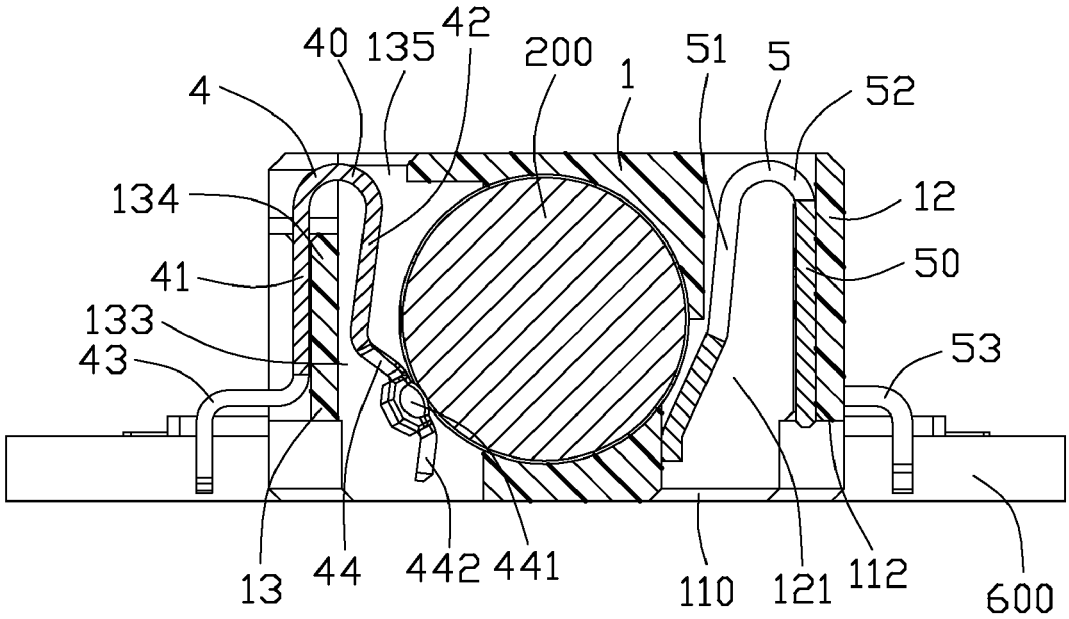
FIG. 8 is another cross-sectional view of the electrical connector taken along line 8-8 of FIG. 1.

Referring to FIGS. 4-6, the hexahedral insulative housing 1 comprises an upper face 10, a lower face 11 opposite to the upper face 10, a pair of side faces 12, 13 connecting with the upper face 10 and the lower face 11, a front face 14, and a rear face (not labeled) opposite to the front face 14. The front face 14 defines an insertion hole 15 for receiving the mating connector 200. The insertion hole 15 extends through the insulative housing 1 from the front face 14 to the rear face. In the present embodiment, the front face 14 is a slantways curved surface for mating with a predetermined figure of the mating connector 200.

Referring to FIGS. 3-6, the insulative housing 1 defines a pair of first passageways 16 adjacent to the rear face and communicating with the outside from the upper face 10. The first passageways 16 are symmetrical relative to the insertion hole 15. A pair of first contacts 3 are assembled into the first passageways 16 from the rear face of the insulative housing 1. The first contacts 3 are symmetrically received in the first passageways 16. Each first contact 3 comprises a base portion 30 in an upright location when assembled in the insulative housing 1, a contacting portion 31 extending from the base portion 30 into the insertion hole 15, a connecting portion 32 connecting the base portion 30 and the contacting portion 31 at a front part thereof, a soldering portion 33 laterally extending from the base portion 30 out of the insulative housing 1 for soldering on the printed circuit board 600, and a plurality of fixing portions 34 formed at an upper side of the base portion 30 for interference fit in each first passageway 16. The contacting portion 31 forms a flat piece 310 substantially parallel with the base portion 30 and when the mating connector 200 is inserted into the insertion hole 15, the contacting portion 31 is deflected by the mating connector 200 towards the base portion 30 and the flat piece 310 may contact with the base portion 30 so as to prevent over deflection of the contacting portion 31.

Referring to FIGS. 3-6, the insulative housing 1 defines a pair of second passageways 131 at the same side face 13 thereof. Different from the first passageways 16, the second passageways 131 are defined adjacent to the front face 14, and one second passageway 131 is aligned with the other second passageway 131 along the mating direction. Each second passageway 131 comprises a first slot 132 opening to the outside and a second slot 133 situated between the first slot 132 and the insertion hole 15 along a transverse direction perpendicular to the mating direction. The second slot 133 communicates with the insertion hole 15. The first slot 132 defines an outer, narrower slit 1321 and an inner, wider slit 1322. The outer, narrower slit 1321 communicates with the exterior and opens at the upper and lower sides thereof. The wider slit 1322 is located at inner side of the narrower slit 1321 and opens at the upper side thereof while closes at the lower side thereof. The insulative housing 1 forms a supporting part 134 between the first slot 132 and the second slot 133. The supporting part 134 is recessed below the upper face 10. The second slot 133 defines an inlet 135 at the upper face 10 of the insulative housing 1, and the inlet 135 has a reduced lateral width, which prevents dust from entering into the insertion hole 15 through the second slot 133.

Referring to FIGS. 1-6, a pair of second contacts 4 is respectively assembled into the second passageways 131 from the upper face 10 of the insulative housing 1. The second contacts 4 are arranged in the second passageways 131 along the mating direction. Each second contact 4 comprises a curved portion 40 at a top thereof, a first arm portion 41 and a second arm portion 42 extending downwardly from the curved portion 40, a rear portion 43 extending laterally, downwardly from the first arm portion 41, and a second contacting portion 44 extending laterally, downwardly from the second arm portion 42. The first arm portion 41 and the second arm portion 42 of the second contact 4 are respectively and correspondingly received in the first slot 132 and the second slot 133. In the embodiment shown, the first arm portion 41 forms a plurality of bars 410 for being received in the inner, wider slit 1322. The rear portion 43 extends out of the insulative housing 1 through the outer, narrower slit 1321 for connecting with the printed circuit board 600. The second contacting portion 44 extends into the insertion hole 15. In the preferred embodiment, the second contacting portion 44 forms a guiding portion 441 extending toward the front face 14 in the insertion hole 15 and a tail 442. The second contacts 4 are steadily assembled in the insulative housing 1.

The insulative housing 1 defines a third passageway 121 at the side face 12 which opposite to the second passageways 122 relative to the insertion hole 15. A third contact 5 is assembled in the third passageway 121 from the upper face 10 of the insulative housing 1. Similar to the second contact 4, the third contact 5 comprises a third curved portion 52, a third arm portion 50 and a fourth arm portion 51 extending downwardly from two ends of the third curved portion 52, a third rear portion 53 extending laterally, downwardly from the third arm portion 50, and a flexible beam 512 extending forwardly from the fourth arm portion 51. In a preferred embodiment, the flexible beam 512 forms a third contacting portion 513 at a front end thereof. The third arm portion 50 is stamped to have a cutout 502 for receiving a protrusion (not shown) of the insulative housing 1 and retaining the third contact 5 in the third passageway 121 of the insulative housing 1 thereby.

Figure 2:
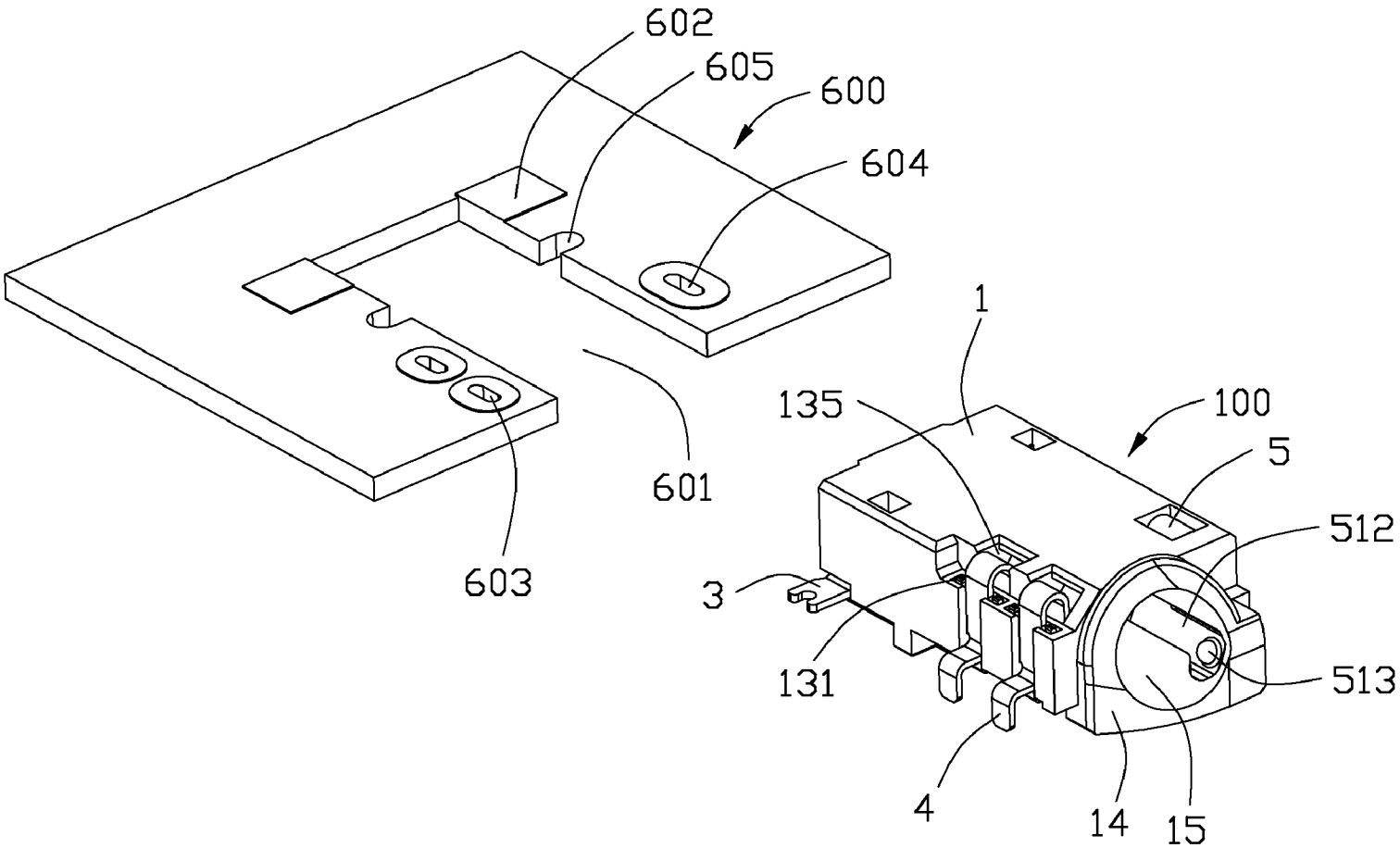
FIG. 2 is a perspective view of the electrical connector and the printed circuit board separated from the electrical connector.
Figure 3:
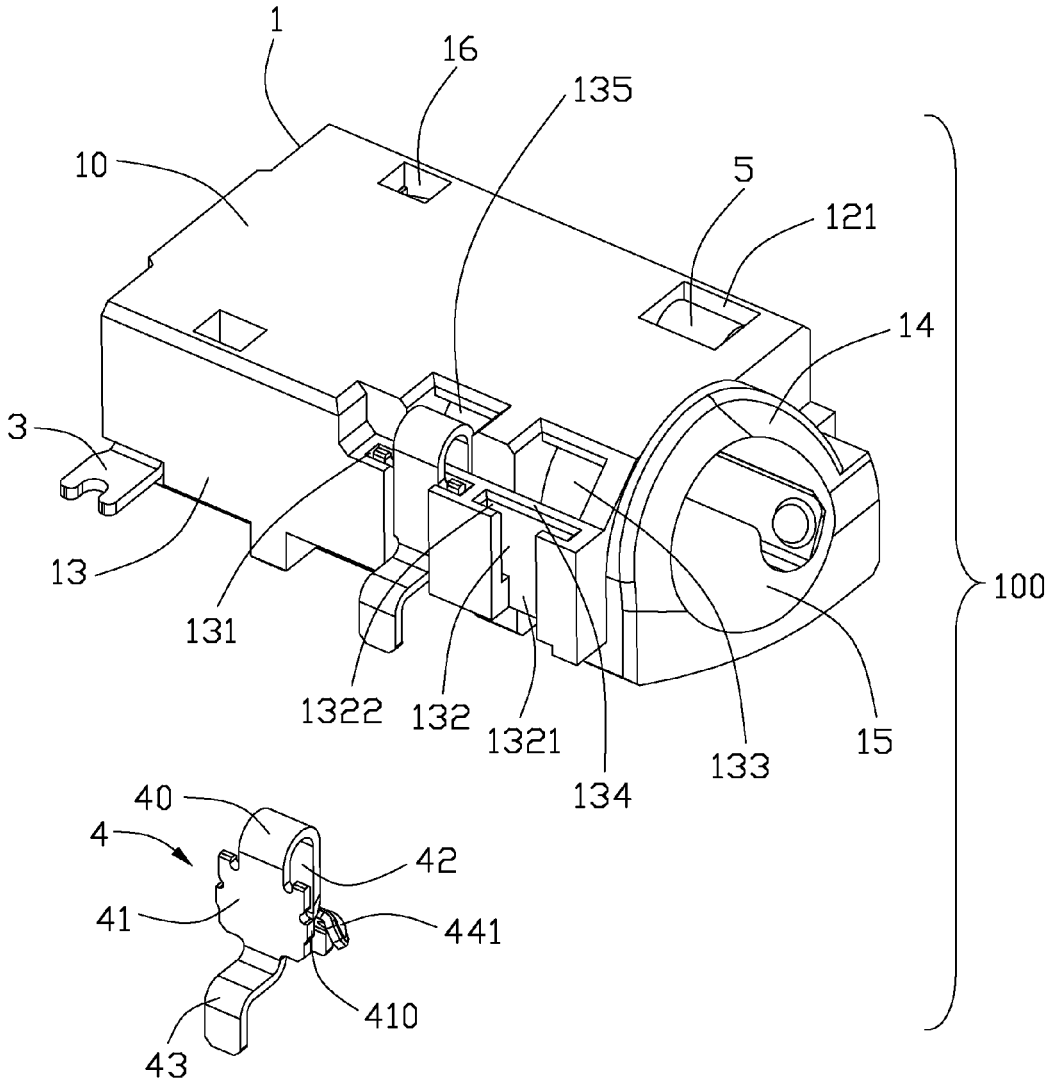
FIG. 3 is a perspective, partly exploded view of the electrical connector with a contact separated therefrom.

Referring to FIG. 2, the printed circuit board 600 is rectangular shaped and defines a cutout 601 allowing the electrical connector 100 to partly being arranged therebelow and partly being arranged thereabove. The printed circuit board 600 defines a plurality of retaining holes 603, 604 respectively receiving the rear portions 43, 53 of the second, third contacts 4, 5. The printed circuit board 600 further defines a pair of soldering pads 602 for connecting with the soldering portions 33 of the first contact 3. The printed circuit board 600 defines a pair of notches 605 facing towards the cutout 601 for receiving retaining poles (not labeled) of the insulative housing 1. In a preferred embodiment of the present invention, the retaining holes 603, 604 and the soldering pads 602 are arranged at opposite sides of the notches 605 for balance.

In the present invention, because the second contacts 4 are respectively assembled into the second passageways 131 from the upper face 10 of the insulative housing 1, the first arm portion 42 is retained in the first slot 132 of the passageway 131 and therefore, the second contacts 4 are steadily assembled in the insulative housing 1 and are prevented from falling off from the insulative housing 1 even though a large insertion force is exerted during the mating connector's insertion.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing defining an insertion hole along a mating direction and a passageway opening at an upper face thereof, the passageway having a first slot at a side face of the insulative housing and a second slot positioned between the first slot and the insertion hole along a transverse direction which is perpendicular to the mating direction, the second slot communicating with the insertion hole, the insulative housing comprising a supporting part between the first slot and the second slot; and at least one contact assembled to the insulative housing from the upper face and comprising a curved portion crossing over the supporting part, a first arm portion extending downwardly from the curved portion and retained in the first slot of the passageway, a second arm portion extending downwardly from the curved portion and received in the second slot of the passageway, and a contacting portion extending from the second arm portion into the insertion hole.

2. The electrical connector as claimed in claim 1, wherein the first slot comprises an outer slit and an inner slit, and the inner slit is wider than the outer slit and retains the first arm portion.

3. The electrical connector as claimed in claim 2, wherein the inner slit is closed at a lower side thereof.

4. The electrical connector as claimed in claim 2, wherein the at least one contact comprises a rear portion extending from the first arm portion, and the rear portion extends out of the insulative housing through the outer slit.

5. The electrical connector as claimed in claim 1, wherein the second slot defines an inlet at the upper face of the insulative housing, and the inlet has a reduced lateral width.

6. The electrical connector as claimed in claim 1, further comprising a pair of first contacts assembling to the insulative housing from a rear face thereof and a third contact assembling to the insulative housing from a bottom face thereof, and wherein the at least one contact comprises a pair of second contacts assembling to the insulative housing from the upper face thereof.

7. The electrical connector as claimed in claim 6, wherein the first contacts are positioned at a rear part of the insulative housing which is distal from the insertion hole.

8. The electrical connector as claimed in claim 7, wherein the first contacts are disposed symmetrically relative to the insertion hole.

9. The electrical connector as claimed in claim 6, wherein the second contacts and the third contact are positioned at a front part of the insulative housing and adjacent to the insertion hole.

10. The electrical connector as claimed in claim 9, wherein the second contacts are disposed at one side face of the insulative housing and the third contact is disposed at the opposite side face of the insulative housing facing towards the second contacts.

11. The electrical connector as claimed in claim 6, wherein the first contacts has a pair of surface-mount soldering portions.

12. The electrical connector as claimed in claim 6, wherein each of the second contacts and the third contact has a through-hole rear portion.

13. An electrical connector comprising:

an insulative housing defining a columnar receiving hole along an axial direction and forwardly communicating with an exterior for receiving a columnar plug;

a first contact receiving passage located on one lateral side of the receiving hole, and laterally communicating with the receiving hole;

a retaining slot located outside of said first contact receiving passage and essentially isolated from said first contact receiving passage via a partition wall; wherein a first contact downwardly assembled into the housing and straddling the partition wall under condition that said first contact includes a first retention section retained in the retaining slot and a first resilient contacting section disposed in the first contact receiving passage and extending into the columnar receiving hole for engagement with the columnar plug.

14. The electrical connector as claimed in claim 13, wherein said housing further includes a second contact receiving passage on the other lateral side thereof to laterally communicate with the columnar receiving hole, and a second contact is upwardly assembled into the second contact receiving passage from a bottom under condition that said second contact includes a second resilient contacting section and a second retention section both received in the second contact receiving passage.

15. An electrical connector assembly comprising:

a printed circuit board defining a cutout dimensioned to receive an insulative housing therein;

said insulative housing defining a columnar receiving hole along an axial direction and forwardly communicating with an exterior for receiving a columnar plug;

said housing being configured to receive a first contact and a second contact as characterized below:

said first contact upwardly assembled into the housing and including a first resilient contacting section essentially extending along a horizontal direction and extending into the columnar receiving hole, and a horizontally extending first mounting section to be surface mounted upon the printed circuit board; and said second contact assembled into the housing and including a second resilient contacting section essentially extending along a vertical direction perpendicular to said horizontal direction and extending into the columnar receiving hole, and a vertically extending second mounting section to extend through the printed circuit board.

16. The electrical connector assembly as claimed in claim 15, wherein said second contact further includes a horizontal section linked to a top portion of the vertically extending second mounting section while being spaced from the printed circuit board.

17. The electrical connector assembly as claimed in claim 15, wherein said second contact is downwardly assembled to the housing.

* * * * *